US009616664B2

(12) United States Patent
Oikawa et al.

(10) Patent No.: US 9,616,664 B2
(45) Date of Patent: Apr. 11, 2017

(54) LIQUID EJECTION HEAD

(71) Applicant: CANON KABUSHIKI KAISHA

(72) Inventors: Masaki Oikawa, Inagi (JP); Hiroshi Yamada, Yokohama (JP); Atsushi Omura, Kawasaki (JP); Satoshi Kimura, Kawasaki (JP); Kousuke Nakahata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/202,993

(22) Filed: Jul. 6, 2016

(65) Prior Publication Data

US 2017/0021620 A1 Jan. 26, 2017

(30) Foreign Application Priority Data

Jul. 24, 2015 (JP) ..... 2015-146457

(51) Int. Cl.
*B41J 2/145* (2006.01)
*B41J 2/14* (2006.01)
*B41J 2/21* (2006.01)

(52) U.S. Cl.
CPC ..... *B41J 2/1433* (2013.01); *B41J 2/21* (2013.01)

(58) Field of Classification Search
CPC .... B41J 2002/14306; B41J 2/145; B41J 2/17; B41J 2/1433; B41J 2/21
See application file for complete search history.

(56) References Cited

U.S. PATENT DOCUMENTS 6,976,754 B2 12/2005 Ohashi et al.
7,594,714 B2 * 9/2009 Katayama ..... B41J 2/14201 347/68
2002/0039120 A1 * 4/2002 Otsuka ..... B41J 2/1433 347/29
2015/0343775 A1 12/2015 Kudo et al.

FOREIGN PATENT DOCUMENTS

JP 2004-122463 A 4/2004
JP 2006-240150 A 9/2006

* cited by examiner

*Primary Examiner* — Thinh H Nguyen
(74) *Attorney, Agent, or Firm* — Fitzpatrick, Cella, Harper & Scinto

(57) ABSTRACT

Provided is a liquid ejection head, including: an ejection unit including: a recording element substrate including a plurality of recording elements configured to generate energy; and a support member formed of a plate-like member and configured to support the recording element substrate, the support member including: a liquid chamber configured to store liquid therein, and an inlet formed in the liquid chamber so as to allow the liquid to flow into the liquid chamber; a flow path unit including a liquid path through which the liquid is supplied into the ejection unit from a liquid tank storing the liquid therein; a joint member sandwiched between the support member and the flow path unit and configured to seal the liquid; and a buffer chamber formed in a space defined by the joint member, the ejection unit, and the flow path unit and configured to retain gas therein.

8 Claims, 10 Drawing Sheets

53
52
C2
51
56
55
55
C1
55

55
R
M
55

61
62
63
DISPLACEMENT OF MENISCUS VIBRATION
TIME [μs]
0
100
200
300
400
500

64
65
66
DISPLACEMENT OF MENISCUS VIBRATION
TIME [μs]

LIQUID EJECTION HEAD

BACKGROUND OF THE INVENTION

Field of the Invention

The present invention relates to a liquid ejection head configured to perform recording by ejecting liquid such as recording liquid from ejection orifices onto a recording medium such as paper or cloth.

Description of the Related Art

For example, as described in Japanese Patent Application Laid-Open No. 2004-122463, a general liquid ejection head includes a recording element substrate having an array of a plurality of ejection orifices and a supply port formed therein for the array of ejection orifices, and a support member including a liquid chamber formed therein. The recording element substrate is mounted onto the support member. Thus, the liquid chamber and the supply port are connected to each other, and a path of liquid is defined from the liquid chamber to the ejection orifices. Into the liquid chamber, the liquid is supplied from a liquid tank being a supply source of the liquid. Further, in recent years, in the liquid ejection head, the number of the ejection orifices arranged in an ejection orifice array is increased to satisfy a need for high-speed recording. Accordingly, there has been a need for design of a flow path capable of supplying the liquid such as recording liquid to the ejection orifice array at a high flow rate.

In the liquid ejection head, under a state in which a meniscus of the liquid such as the recording liquid is formed at each of the ejection orifices, energy is applied to the liquid, thereby ejecting droplets of the liquid forward. In this case, the term "forward" means a direction receding from the liquid ejection head with respect to a surface in which the ejection orifices are formed. Into the ejection orifices, an amount of the liquid equal to a volume of ejected droplets is supplied from the supply port side. At this time, menisci at the ejection orifices are significantly vibrated by vibration of the liquid, with the result that liquid droplets to be ejected at the time of next ejection may not be stable. When the liquid droplets are not stable due to vibration of the menisci, quality of an image formed on a recording medium is significantly degraded when the liquid ejection head is, for example, an inkjet recording head. Particularly in a liquid ejection head in which a large number of ejection orifices are arranged at a high density, a flow rate of the liquid per unit time is high. For example, when ejection of a large amount of liquid is started at one time, at this moment, an inertial force of moving the liquid forward is small in the liquid ejection head. Accordingly, the liquid is not sufficiently refilled into the ejection orifices that are positioned downstream of the liquid chamber and the supply port. Thus, next ejection is started under a state in which the menisci at the ejection orifices are concave. Further, when ejection of the large amount of liquid is stopped at one time, at this moment, the inertial force of moving the liquid forward is large in the liquid ejection head. Accordingly, the liquid in the ejection orifices is pushed out by the inertial force, with the result that the menisci at the ejection orifices are convex. Incidentally, in general, the liquid tank, which is the supply source of the liquid, is structured so as to continuously apply negative pressure to the liquid in order to prevent the liquid from dripping from the ejection orifices of the liquid ejection head. With this structure, the liquid supplied from the liquid tank is subjected to application of a force of returning the liquid to an upstream side. Thus, the liquid in a meniscus convex state at the ejection orifices is likely to retreat and return into the ejection orifices after the meniscus convex state.

As described above, in the liquid ejection head, along with ejection of the liquid, at the start of ejection and after the stop of ejection, there is induced such a phenomenon (so-called meniscus vibration) that the menisci at the ejection orifices are convexed forward or concaved backward. Meniscus vibration is intensified as a flow rate of the liquid to be ejected per unit time becomes higher. When a signal for next ejection is input under a state in which the menisci are convexed forward or a state in which the menisci are concaved backward, a large number of small liquid droplets are splashed in the former state, with the result that recording with splashes is formed on the recording medium. Further, in the latter state, ejection speed and an ejection amount are reduced, with the result that recording with a faint part is formed. In the both states, recording quality is degraded.

As described in Japanese Patent Application Laid-Open No. 2004-122463 and Japanese Patent Application Laid-Open No. 2006-240150, in order to suppress meniscus vibration and to keep satisfactory recording quality, a buffer chamber accumulating air bubbles therein is formed in a liquid chamber, or in a flow path extending from a tank to the liquid chamber. The buffer chamber is formed to buffer and attenuate pressure vibration that causes meniscus vibration. In general, the buffer chamber, which accumulates air bubbles therein, can attenuate even quicker pressure vibration, namely, pressure vibration having a higher frequency component when the buffer chamber is formed at a position closer to ejection orifices from which the liquid is ejected. Further, the buffer chamber having a larger volume can attenuate even pressure vibration having larger amplitude.

As described in Japanese Patent Application Laid-Open No. 2004-122463, when the buffer chamber is formed in a halfway point of a liquid flow path extending from the tank to the liquid chamber, a volume of the buffer chamber can be increased. Thus, the buffer chamber can attenuate and buffer even larger pressure vibration. However, in this case, a position of the buffer chamber is distant from the ejection orifices, with the result that the buffer chamber is less likely to attenuate pressure vibration having short cycles. Meanwhile, as described in Japanese Patent Application Laid-Open No. 2006-240150, when the buffer chamber is formed in the liquid chamber, the buffer chamber is located at a position closer to the ejection orifices. Thus, the buffer chamber can attenuate even pressure vibration having short cycles, but it is difficult to increase the volume of the buffer chamber, with the result that the buffer chamber is less likely to attenuate large pressure vibration. After all, when the buffer chamber is formed, it is not possible to achieve both attenuating and buffering even pressure vibration having short cycles, and attenuating and buffering pressure vibration having large amplitude.

It is an object of the present invention to provide a liquid ejection head capable of reliably attenuating meniscus vibration at ejection orifices, which causes degradation in recording quality, and capable of performing recording at high speed with high quality even when the number of the ejection orifices is increased to satisfy a need for high-speed recording and it is necessary to supply ink at a high flow rate.

SUMMARY OF THE INVENTION

According to one embodiment of the present invention, there is provided a liquid ejection head, including: an ejection unit including a recording element substrate having ejection orifices for allowing liquid to be ejected from the ejection orifices, the recording element substrate including a plurality of recording elements configured to generate energy for ejecting the liquid from the ejection orifices, and a support member formed of a plate-like member, the support member joining and fixing the recording element substrate thereon, the support member including a liquid chamber configured to temporarily store therein the liquid to be supplied to the recording element substrate, and an inlet formed in the liquid chamber so as to allow the liquid to flow into the liquid chamber; a flow path unit including a liquid path through which the liquid is supplied into the ejection unit from a liquid tank storing the liquid therein; a joint member sandwiched between the support member and the flow path unit and configured to seal the liquid while keeping the liquid flowing between an outlet of the liquid path of the flow path unit and the inlet of the support member; and a buffer chamber formed in a space defined by the joint member, the ejection unit, and the flow path unit and configured to suppress vibration of the liquid in the liquid chamber.

Further features of the present invention will become apparent from the following description of exemplary embodiments with reference to the attached drawings.

DESCRIPTION OF THE EMBODIMENTS

Next, exemplary embodiments of the present invention are described with reference to the attached drawings.

First Embodiment

Figure 1:
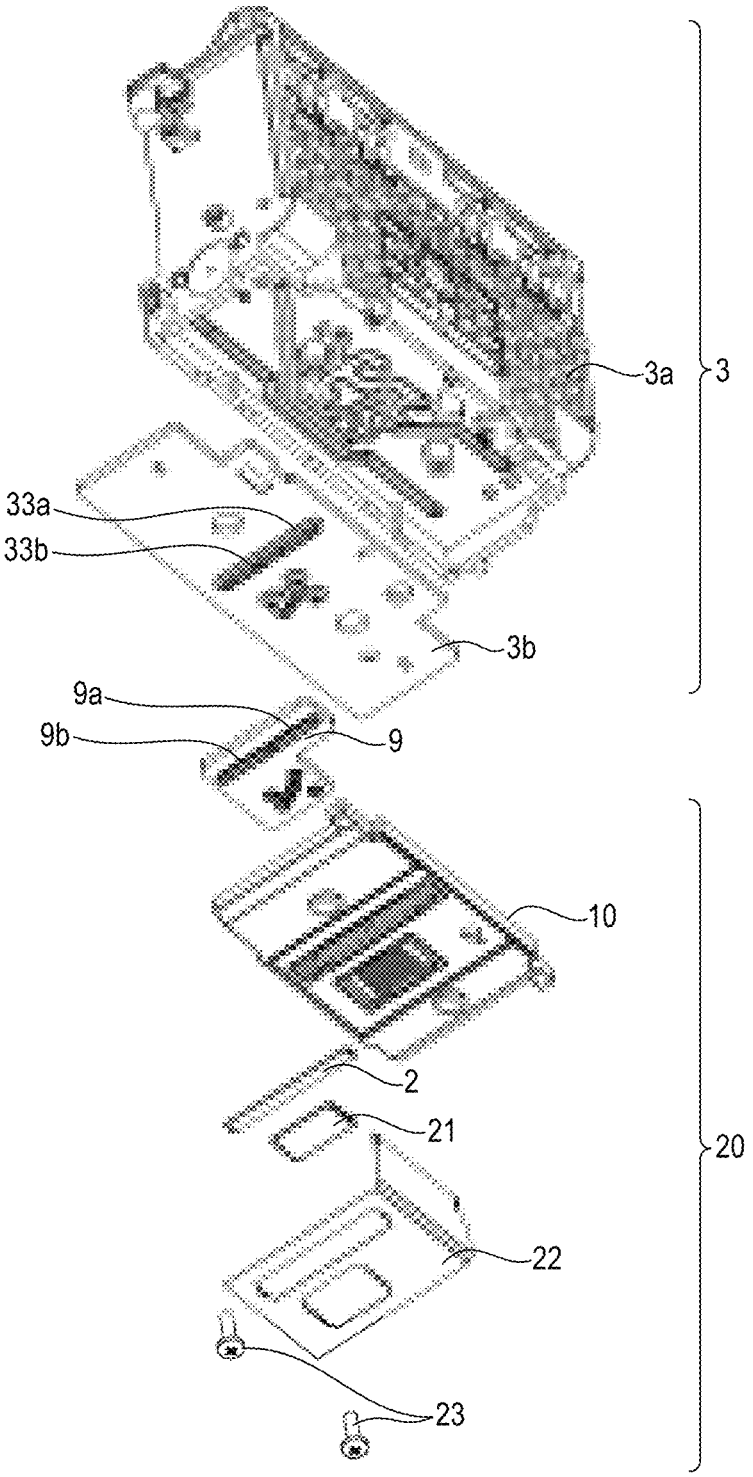
FIG. 1 is an exploded perspective view for illustrating a configuration and an assembly of components of a liquid ejection head according to first and third embodiments of the present invention.
Figure 2:
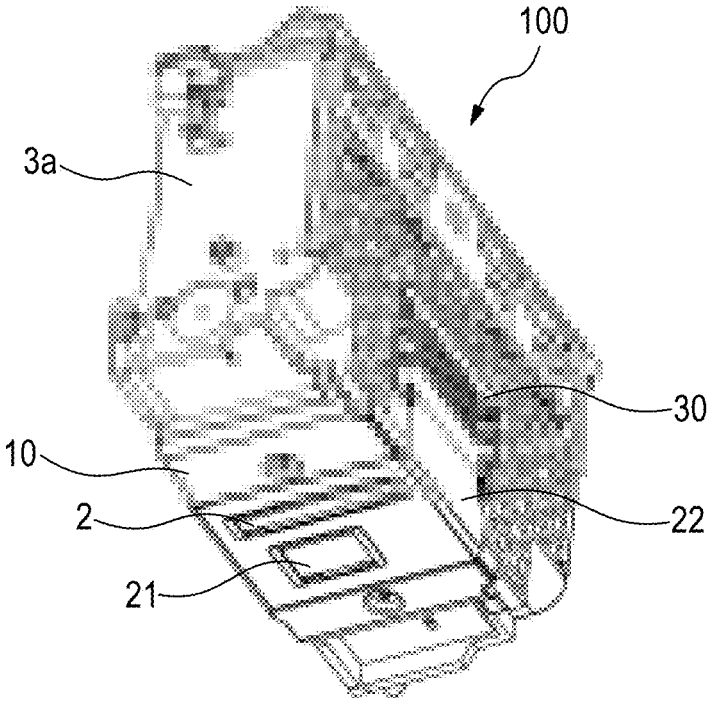
FIG. 2 is a perspective view for illustrating the liquid ejection head according to the first and third embodiments.

FIG. 1 is a view for illustrating a configuration and an assembly of components of a liquid ejection head configured to eject liquid such as ink according to a first embodiment of the present invention, and FIG. 2 is a view for illustrating the liquid ejection head after completion of assembly. A liquid ejection head 100 is mounted in a liquid ejection apparatus, and is capable of reliably attenuating meniscus vibration at ejection orifices. In the following description, the liquid ejection head 100 is structured as an inkjet recording head, but the liquid ejection head according to the present invention is also applicable to other use than the inkjet recording head. First, prior to description of a configuration for attenuating meniscus vibration, an entire configuration of the liquid ejection head 100 is roughly described. The illustrated liquid ejection head 100 is configured to eject, as liquid for recording, for example, a black ink and six color inks other than the black ink. The black ink and the color inks are collectively referred to as recording liquid.

A casing 3*a* holds a liquid tank in which liquid (recording liquid in this example) to be ejected from the liquid ejection head is stored, and a flow path plate 3*b* is joined to the casing 3*a* by welding or other methods. The casing 3*a* and the flow path plate 3*b* construct a flow path unit 3. The liquid tank is not illustrated in FIG. 1 and FIG. 2 because the liquid tank is hidden by the casing 3*a*.

Meanwhile, a recording element substrate 2 having an ejection orifice array formed therein and configured to eject the black ink, and a recording element substrate 21 having six ejection orifice arrays formed therein and configured to eject the color inks are positioned to a support member 10, and are joined and fixed to the support member 10. The support member 10 is a plate-like member having inlets and a liquid chamber formed therein. The recording liquid is taken into the support member 10 from the inlets, and the recording liquid is temporarily stored in the liquid chamber. In each of the recording element substrates 2 and 21, a plurality of ejection orifices are arrayed to construct the ejection orifice array, and a pressure chamber is prepared for each ejection orifice. In each pressure chamber, there is arranged a recording element configured to generate energy for ejecting the ink from the corresponding ejection orifice. The ejection orifice array formed in the recording element substrate 2 for the black ink has a length corresponding to a recording width of 25.4 mm, whereas the ejection orifice arrays formed in the recording element substrate 21 for the color inks each have a length corresponding to a recording width of 12.7 mm. In order to send recording electric signals to the respective recording elements of the recording element substrates 2 and 21, an electric wiring substrate 22 is positioned and joined to the support member 10, and electric wires are also joined to the recording element substrates 2 and 21. The support member 10, the recording element substrates 2 and 21, and the electric wiring substrate 22 construct an ejection unit 20.

The flow path unit 3 and the ejection unit 20 described above sandwich a joint member 9 therebetween, and are fixed with screws 23 from the ejection unit 20 side. Thus, the flow path unit 3 and the ejection unit 20 are fixed to each other through intermediation of the joint member 9 in a press-contact manner. After that, the electric wiring substrate 22 is joined to a wiring substrate 30 (see FIG. 2) fixed to the casing 3*a*, thereby completing the liquid ejection head as illustrated in FIG. 2. In this configuration, as described later, the flow path unit 3 includes a liquid path configured to supply the recording liquid from the liquid tank into the ejection unit 20, and flow path connection portions connecting outlets of the liquid path to the ejection unit 20. The joint member 9 is sandwiched between the flow path unit 3 and the support member 10 of the ejection unit 20, thereby functioning as a seal against the recording liquid. The joint member 9 prevents the recording liquid from leaking through a gap between the flow path unit 3 and the ejection unit 20 while maintaining circulation of the recording liquid between the inlets of the support member 10 for the recording liquid and the outlets of the liquid path of the flow path unit 3. The joint member 9 needs to have openings that are formed therein and pass therethrough in order to supply the recording liquid from the flow path unit 3 into the ejection unit 20. Further, as the flow path connection portions, annular protrusions to be fitted into the openings of the joint member 9 are formed in the flow path plate 3*b*. The outlets of the liquid path are open inside the flow path connection portions. In the following description, the outlets of the liquid path for the black ink are referred to as outlets 33*a* and 33*b*, and the openings corresponding to the outlets of the liquid path for the black ink and passing through the joint member are referred to as openings 9*a* and 9*b*. The joint member 9 is formed of an elastic member such as a rubber member or a member obtained by curing an adhesive, but may be formed of other kinds of members.

In the liquid ejection head according to this embodiment, for the black ink, a buffer chamber, which is configured to suppress vibration of the recording liquid in the liquid chamber formed in the support member 10, is formed in a space defined by the joint member 9, the flow path unit 3, and the ejection unit 20. Gas is retained in the buffer chamber, and the gas buffers pressure fluctuation caused when the ink is ejected. Specifically, in order to obtain a buffer chamber space defined when the flow path unit 3 is joined to the ejection unit 20, in the flow path plate 3*b* of the flow path unit 3, a recessed portion is formed at a position within a region of each flow path connection portion and around each outlet of the liquid path. In general, the flow path plate 3*b* is a member formed by molding a resin. Thus, in a process of manufacturing the flow path plate 3*b*, the recessed portion is easily formed simultaneously with the liquid path and each flow path connection portion. As another method for obtaining the buffer chamber space in the space defined by the joint member 9, the flow path unit 3, and the ejection unit 20, a partition or a dead-end portion may be formed in the joint member 9. As a method for obtaining the buffer chamber space, the recessed portion or the partition may be formed on the support member 10 side. Alternatively, the buffer chamber space may be further increased by combining the above-mentioned methods. In this embodiment, for the color inks, buffer chambers are not formed in the space defined by the joint member 9, the flow path unit 3, and the ejection unit 20 because an estimated flow rate of the recording liquid is low and a length of the ejection orifice array for each color is small. The following description relates to the buffer chamber formed in a supply path for the black ink according to this embodiment.

Figure 3B:
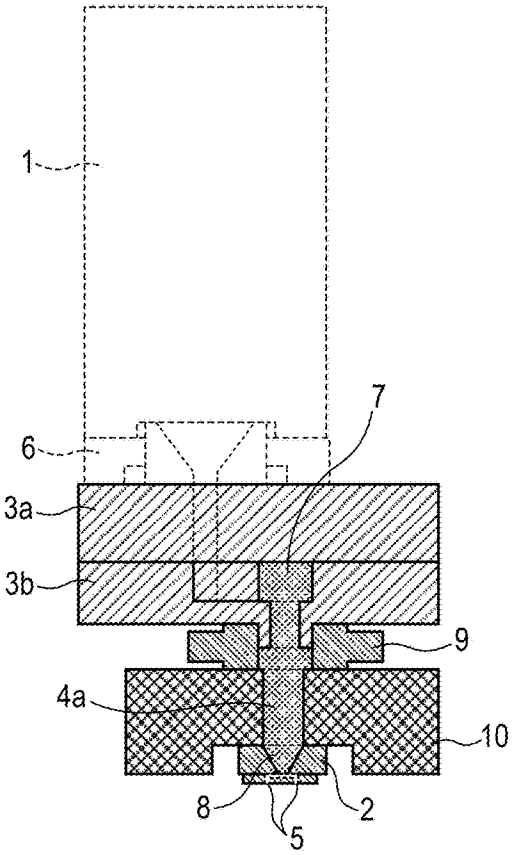
FIGS. 3A and 3B are sectional views for illustrating the internal structure of the liquid ejection head according to the first embodiment.
Figure 3A:
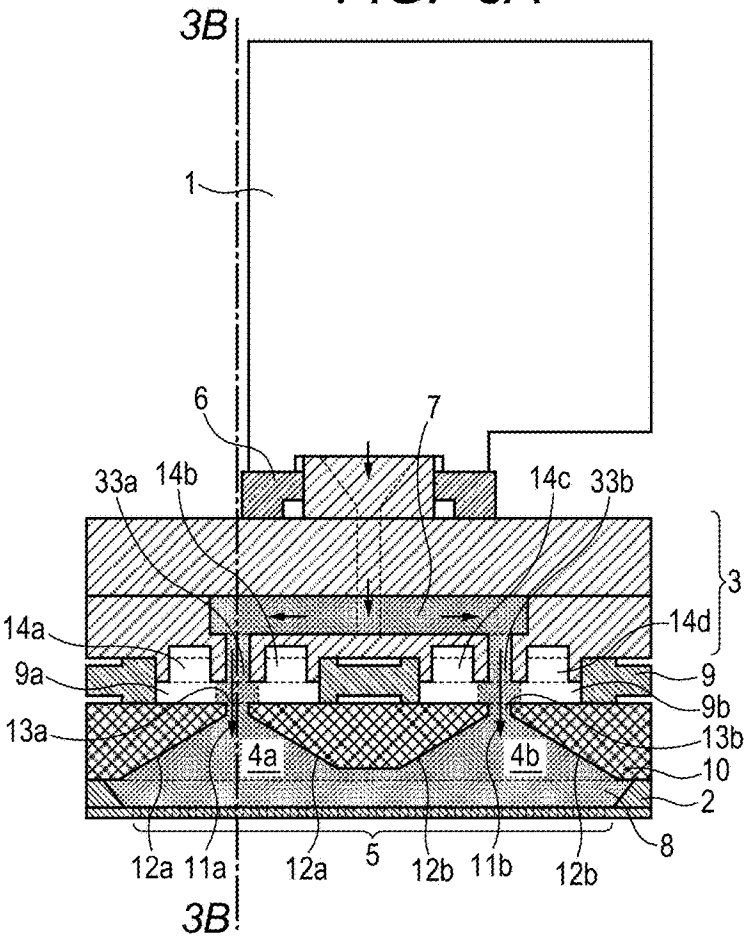

Now, the liquid ejection head according to this embodiment is further described in detail with reference to FIG. 3A and FIG. 3B. FIG. 3A is a sectional view for illustrating a flow of the black ink from a liquid tank 1 to an ejection orifice array 5, and FIG. 3B is a sectional view taken along the line 3B-3B of FIG. 3A. In this case, for ease of description, of portions of the casing 3*a*, a portion positioned on a side surface of the liquid tank 1 is not illustrated.

In FIG. 3A and FIG. 3B, the liquid tank 1 is pressed against a tank sealing rubber 6, to thereby be fixed to an inner bottom surface of the casing 3*a* of the flow path unit 3. The recording liquid in the liquid tank 1 is led into the liquid ejection head 100 by reducing pressure in the liquid ejection head 100 or applying pressure in the liquid tank. First, the recording liquid is supplied through a through-hole, which is formed in the inner bottom surface of the casing 3*a*, into a liquid path 7 defined by the casing 3*a* and the flow path plate 3*b*. The recording liquid is supplied to a center portion of the linear liquid path 7. The recording liquid is distributed toward both ends of the liquid path 7 with respect to the supplied position, and the liquid path 7 branches off in opposite directions with respect to the led position of the recording liquid. Outlets at the both ends of the liquid path 7 are respectively the outlets 33*a* and 33*b* configured to supply the distributed recording liquid into the support member 10. Two liquid chambers 4*a* and 4*b* are also formed in the support member 10 so as to respectively correspond to the two outlets 33*a* and 33*b* formed in the flow path plate 3*b*. The liquid chambers 4*a* and 4*b* are continuously arranged along a direction of the ejection orifice array 5, but a portion protruding toward the recording element substrate 2 exists in the support member 10 between the both liquid chambers 4*a* and 4*b*. Thus, the liquid chambers 4*a* and 4*b* are separated from each other. The recording liquid, which flows out of the flow path plate 3*b* through the outlets 33*a* and 33*b* and then is supplied into the support member 10, is filled into the liquid chambers 4*a* and 4*b* through paths 11*a* and 11*b* indicated by the arrows of FIG. 3A. The inlets formed in the support member 10 are inlets for the recording liquid flowing into the liquid chambers 4*a* and 4*b*, and hence are referred to as inlets 13*a* and 13*b*, respectively. In the openings 9*a* and 9*b* of the joint member 9, the inlets 13*a* and 13*b* almost face the outlets 33*a* and 33*b*, respectively, but gaps to be communicated to buffer chambers 14*a* to 14*d* described later are formed between the outlet 33*a* and the inlet 13*a* and between the outlet 33*b* and the inlet 13*b*. An inner diameter of each of the inlets 13*a* and 13*b* is slightly larger than an inner diameter of each of the outlets 33*a* and 33*b*.

The two openings 9*a* and 9*b* are formed in the joint member 9 so as to correspond to the two outlets 33*a* and 33*b*, respectively. Each of the outlets 33*a* and 33*b* itself has substantially a circular shape, whereas each of the openings 9*a* and 9*b* has an elongated shape in order to define the buffer chambers. The openings 9*a* and 9*b* each have a width capable of just receiving an outer rim of the outlet 33*a* or 33*b*, but have a length considerably larger than the outer diameter of the outlet 33*a* or 33*b*. With this configuration, the buffer chambers 14*a* to 14*d* are defined in a space surrounded by the flow path plate 3*b*, the joint member 9, and the support member 10. The two buffer chambers 14*a* and 14*b* are defined on both sides of the opening 9*a* with respect to a position of the outlet 33*a*, and the two buffer chambers 14*c* and 14*d* are defined on both sides of the opening 9*b* with respect to a position of the outlet 33*b*. The above-mentioned recessed portions are formed in the surface of the flow path plate 3*b* so as to correspond to the buffer chambers 14*a* to 14*d*, respectively. At this time, the buffer chambers 14*a* to 14*d* are defined as dead-end spaces for the recording liquid flowing from the outlets 33*a* and 33*b* into the inlets 13*a* and 13*b*. Accordingly, minute air bubbles always exist in the buffer chambers 14*a* to 14*d*, with the result that vibration of the recording liquid is buffered and attenuated by the air bubbles in the buffer chambers 14*a* to 14*d*. In this configuration, two of the buffer chambers 14*a* to 14*d* are defined for each of a corresponding pair of the outlet 33*a* and the inlet 13*a* and a corresponding pair of the outlet 33*b* and the inlet 13*b*.

In order to prevent air bubbles from accumulating inside the liquid chambers 4*a* and 4*b*, a slope 12*a* is formed on a side surface of the liquid chamber 4*a* so that the liquid chamber 4*a* extends from the inlet 13*a* of the support member 10 toward an entire region of a supply port 8 of the recording element substrate 2, and a slope 12*b* is formed on a side surface of the liquid chamber 4*b* so that the liquid chamber 4*b* extends from the inlet 13*b* of the support member 10 toward the entire region of the supply port 8 of the recording element substrate 2. That is, the liquid chambers 4*a* and 4*b* are each shaped so as to extend from the inlet 13*a* or 13*b* to the ejection orifice array 5 side in a plane including the inlet 13*a* or 13*b* and the ejection orifice array 5. It is not always necessary to form the slope 12*a* in the liquid chamber 4*a* and the slope 12*b* in the liquid chamber 4*b* into a smooth tapered shape, and the slopes may include such a step as not to inhibit flows of the recording liquid and air bubbles. In a surface of the support member 10 on the recording element substrate 2 side, the outlet side of the liquid chamber 4*a* and the outlet side of the liquid chamber 4*b* are each exposed as an elongated opening portion. A length obtained by adding up the opening portions of the respective liquid chambers 4*a* and 4*b* is substantially equal to a length of the ejection orifice array.

The supply port 8 is formed in the recording element substrate 2. The supply port 8 extends along the ejection orifice array 5, and receives the recording liquid from the both openings of the liquid chambers 4*a* and 4*b*. A pressure chamber for each ejection orifice is communicated to the supply port 8, and the recording liquid filled into the liquid chambers 4*a* and 4*b* is filled into each pressure chamber through the supply port 8. As described above, the recording element (not shown) is arranged in the pressure chamber. A predetermined recording element is selectively driven in this state, with the result that the recording liquid is ejected from the corresponding ejection orifice. In this embodiment, one thousand two hundred and eighty ejection orifices each configured to eject a liquid droplet of 12 pl in each driving of the recording element are arranged at a density of 1,200 per 25.4 mm. Therefore, the ejection orifice array 5 has a length of about 27.1 mm based on an expression of 1280*25.4/1200=27.093 . . . . A maximum repeated frequency of ejection from each ejection orifice is 24 kHz. Therefore, the liquid ejection head is applicable to a liquid ejection apparatus (such as inkjet recording apparatus) configured to eject liquid at a flow rate of 22 ml/min by ejecting the liquid from all ejection orifices. In the example described herein, a thickness (vertical dimension in FIG. 3A and FIG. 3B) of the support member 10 may be set to approximately from 3 mm to 5 mm, and a thickness (vertical dimension in FIG. 3A and FIG. 3B) of the recording element substrate 2 may be set to approximately from 0.5 mm to 1.0 mm.

Figures 4A, 4B, 4C, 4D:
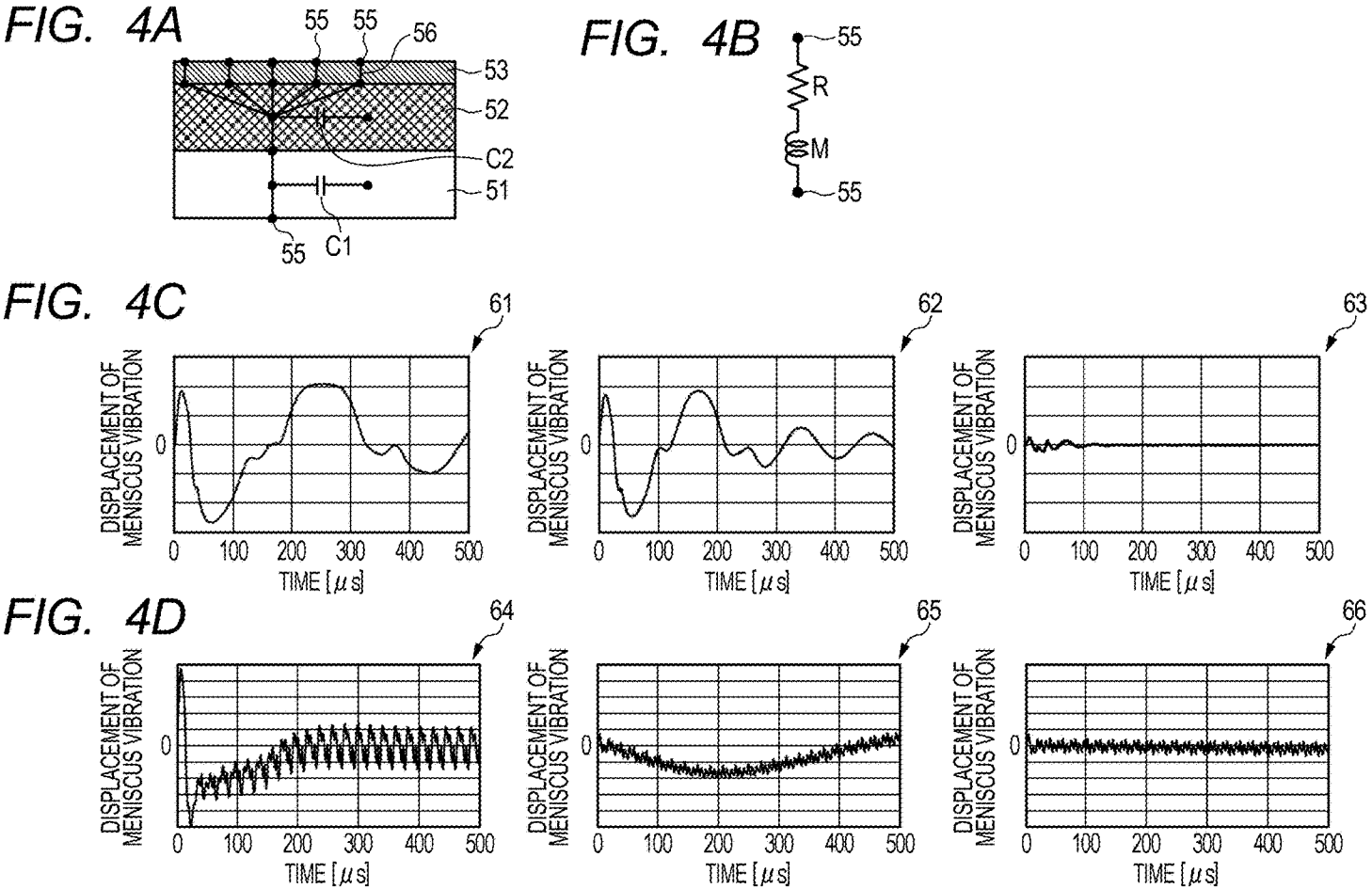
FIG. 4A is an equivalent circuit diagram for illustrating a model for simulation of meniscus vibration.
FIG. 4B is an equivalent circuit diagram for illustrating a branch between nodes in the simulation.
FIGS. 4C and 4D are graphs for showing results of the simulation.

Next, effects obtained by forming the buffer chambers 14*a* to 14*d* in this embodiment as described above are described. FIG. 4A to FIG. 4D are diagrams and graphs of examples of behaviors of meniscus vibration, which are simulated using an equivalent circuit calculation, when the liquid ejection head ejects the liquid from the plurality of ejection orifices. The equivalent circuit calculation is a method of substituting concentrated constants for effects of inertia, viscosity, and rigidity of a fluid in fluid analysis and then solving a linear ordinary differential equation. In this method, a behavior of an electric circuit (equivalent circuit) is calculated on conditions that pressure is equivalent to electric potential; a volumetric flow rate, an electric current; inertance as inertia of the liquid, inductance; viscosity resistance, electric resistance; and a strain of a flow path, compressibility of the liquid, and air bubbles in the flow path, electric capacity (capacitance). In general, the equivalent circuit calculation is sometimes used for analyzing a flow in the liquid ejection head. FIG. 4A is a diagram for illustrating a calculation model of a liquid ejection head for the equivalent circuit calculation. In the calculation model, a part corresponding to the flow path unit 3 of the liquid ejection head 100 is prepared as a flow path part 51, and a part corresponding to the liquid chambers 4*a* and 4*b* of the support member 10 is prepared as a liquid chamber part 52. Further, a part corresponding to the recording element substrate 2 is prepared as an ejection orifice part 53. Nodes 55 are arranged in a path through which the liquid is capable of flowing, and the nodes 55 are connected to each other by branches 56. The nodes 55, which are arranged on an upper side of the ejection orifice part 53 as illustrated in FIG. 4A, correspond to the ejection orifices, respectively. Further, in the calculation model, when simulating an effect of a buffer chamber accumulating air bubbles therein, a capacitance element is added to the desired node 55. For example, when a buffer chamber is formed in the liquid chamber, the buffer chamber is represented by a capacitance C2 as a liquid chamber buffer arranged in the liquid chamber part 52. Similarly, when a buffer chamber is formed in the flow path of the liquid on an upstream side of the liquid chamber, the buffer chamber is represented by a capacitance C1 as a flow path buffer arranged in the flow path part 51. As illustrated in FIG. 4B, in the branches connecting the respective nodes 55 to each other, an inertance element M indicating the effect of inertia of the liquid, and a resistance element R indicating the effect of viscosity of the liquid are connected in series.

FIG. 4C is a set of graphs for showing calculation results of behaviors of meniscus vibration at an ejection orifice under observation when the liquid is ejected at a flow rate of 0.1 ml/min. In this case, the ejection orifice under observation is an ejection orifice that is positioned at a center of the ejection orifice array and ejects no liquid. Three kinds of results are shown in FIG. 4C. Wave profiles of meniscus vibration in a case of forming no buffer chamber (graph 61), a case of forming the buffer chamber in the flow path of the liquid (graph 62), and a case of forming the buffer chamber in the liquid chamber (graph 63) are shown from the left side of FIG. 4C in the stated order. The flow path buffer and the liquid chamber buffer each have a volume of 28 $mm^3$. When the liquid is ejected from the plurality of ejection orifices in a time period from 0 μs to 40 μs shown in FIG. 4C, the liquid is supplied from the liquid tank into the liquid ejection head in order to compensate the ejected amount of liquid. At this time, because of inertia of the liquid in the liquid ejection head, the liquid refilled into the ejection orifices overshoots ejection orifice surfaces. The liquid, which has overshot the ejection orifice surfaces, is moved due to Laplace pressure of a convex meniscus surface so as to be sucked into the liquid ejection head again. As a result, meniscus vibration as illustrated in FIG. 4C is generated.

As is apparent from FIG. 4C, in the case of the buffer chamber in the flow path shown in the graph 62, meniscus vibration is attenuated for a long time period after the lapse of 200 μs, but meniscus vibration cannot be attenuated within a short time period before the lapse of 200 μs because a distance from the ejection orifices to the buffer chamber is large. It is apparent that meniscus vibration is attenuated in an earlier time period in the case of forming the buffer chamber in the liquid chamber positioned close to the ejection orifices (graph 63). That is, with reference to FIG. 4C, it is apparent that amplitude and cycles of vibration are largest in the case of forming no buffer chamber (graph 61), and that the amplitude and the cycles of vibration are decreased and meniscus vibration can be more effectively suppressed as the buffer chamber is formed closer to the ejection orifices. The buffer chambers 14*a* to 14*d* according to this embodiment are located in proximity to positions connecting to the liquid chambers, and have characteristics equivalent to those of the buffer chamber in the liquid chamber in view of buffering vibration, thereby being capable of effectively suppressing meniscus vibration.

As described above, as the buffer chamber is positioned closer to the ejection orifices, the effect of suppressing meniscus vibration when the liquid is ejected from a large number of ejection orifices is increased. This is because magnitude of meniscus vibration generated when driving the large number of ejection orifices is deeply affected by inertia of the liquid in the liquid chamber or the flow path as described above. When a buffer chamber with a sufficient size exists in the liquid chamber or the flow path, immediately after the large number of ejection orifices are driven, air bubbles in the buffer chamber are expanded, with the result that the buffer chamber functions so as to compensate a volume of ejected ink. Owing to this function, inertia of the liquid existing in a region between a formation portion of the buffer chamber and the liquid tank can be considered as effective inertia that affects meniscus vibration. Thus, it is possible to obtain the same effect as the effect obtained when virtual inertia in the liquid ejection head is reduced.

FIG. 4D is a set of graphs for showing wave profiles of meniscus vibration in a case of varying a volume of the buffer chamber formed in the liquid chamber when the liquid is ejected at an ejection frequency of 24 kHz and a flow rate of 22 ml/min. In the simulation, a density of the liquid is set to 1 g/ml. Accordingly, a volumetric flow rate of 22 ml/min is equivalent to a mass flow rate of 22 g/min. In the three kinds of results of FIG. 4D, wave profiles of meniscus vibration in the case of forming no buffer chamber (graph 64), a case of setting a volume of the buffer chamber in the liquid chamber to 1.0 $mm^3$ (graph 65), and a case of setting the volume of the buffer chamber in the liquid chamber to 20 $mm^3$ (graph 66) are shown from the left side of FIG. 4D in the stated order. As shown in FIG. 4D, it is apparent that even when the buffer chamber is formed in the liquid chamber positioned close to the ejection orifices, a sufficient vibration suppressing effect cannot be obtained in the case where the volume of the buffer chamber is small (graph 65) as compared to the case where the volume of the buffer chamber is large (graph 66). In this embodiment, a volume of each of the buffer chambers 14*a* to 14*d* is equivalent to 5 $mm^3$ so that, as a whole, the liquid chambers 4*a* and 4*b* can ensure a buffer volume equivalent to 20 $mm^3$. As shown in FIG. 4D, in this embodiment, it is also possible to effectively suppress meniscus vibration at the time of ejection at a high flow rate.

As described above, the buffer chambers formed in the space defined by the joint member 9, the flow path unit 3, and the ejection unit 20 are particularly effective in a liquid ejection head that performs ejection at a high flow rate. For example, the configuration according to this embodiment is particularly effectively applied to a liquid ejection head having a maximum liquid ejection rate of 15 ml/min or 15 g/min or more. Further, the buffer chambers formed in the space defined by the joint member 9, the flow path unit 3, and the ejection unit 20 are also particularly effective in a liquid ejection head that is likely to have a long ejection orifice array. For example, the configuration according to this embodiment is particularly effectively applied to a liquid ejection head including an ejection orifice array, which has an entire length of 2 cm or more and to which the liquid is supplied from the same liquid tank.

Second Embodiment

Figure 5:
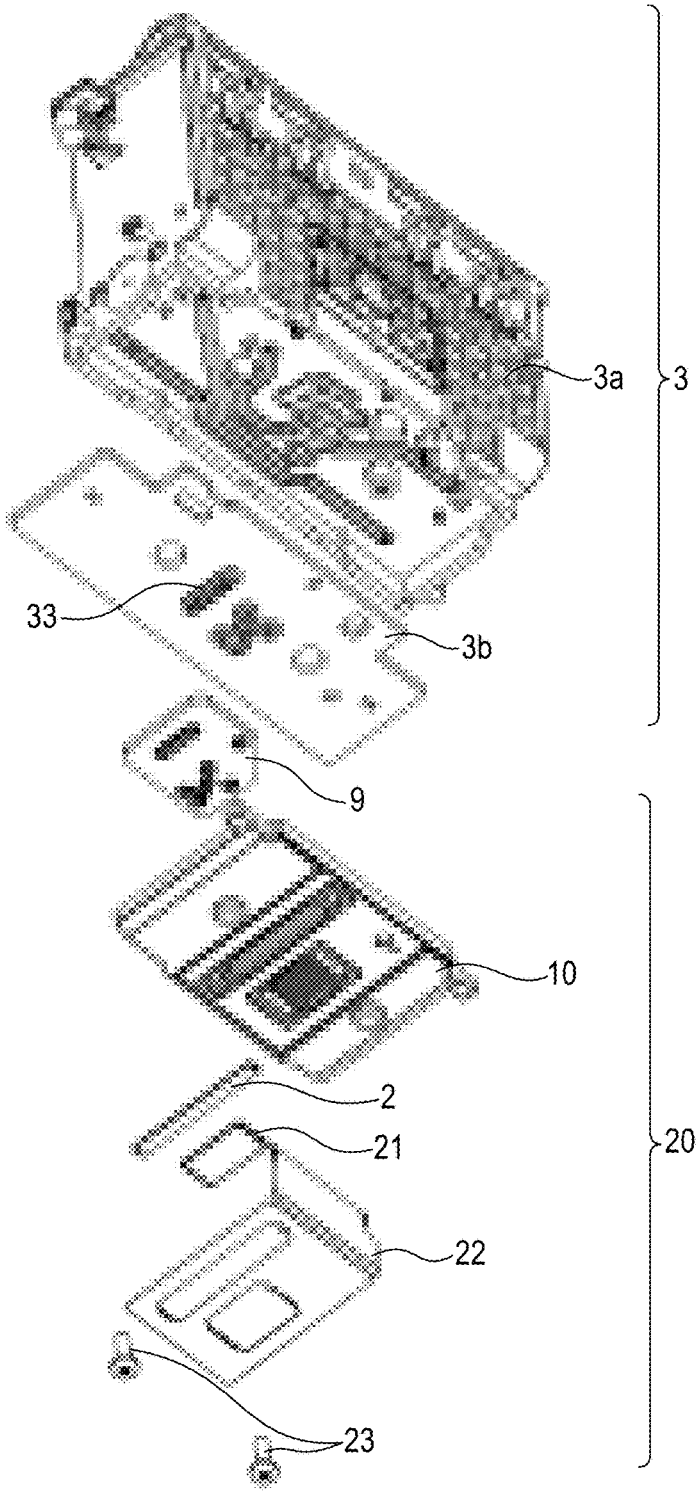
FIG. 5 is an exploded perspective view for illustrating a configuration and an assembly of components of a liquid ejection head according to second and fourth embodiments of the present invention.
Figure 6B:
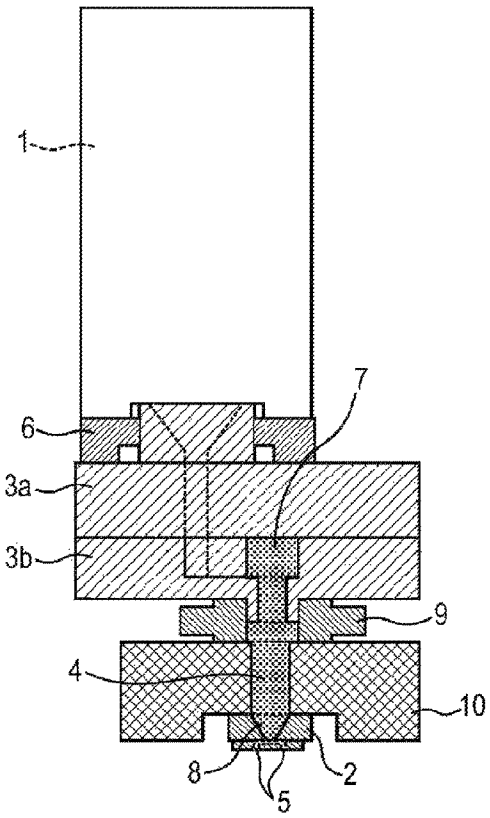
FIGS. 6A and 6B are sectional views for illustrating the internal structure of the liquid ejection head according to the second embodiment.
Figure 6A:
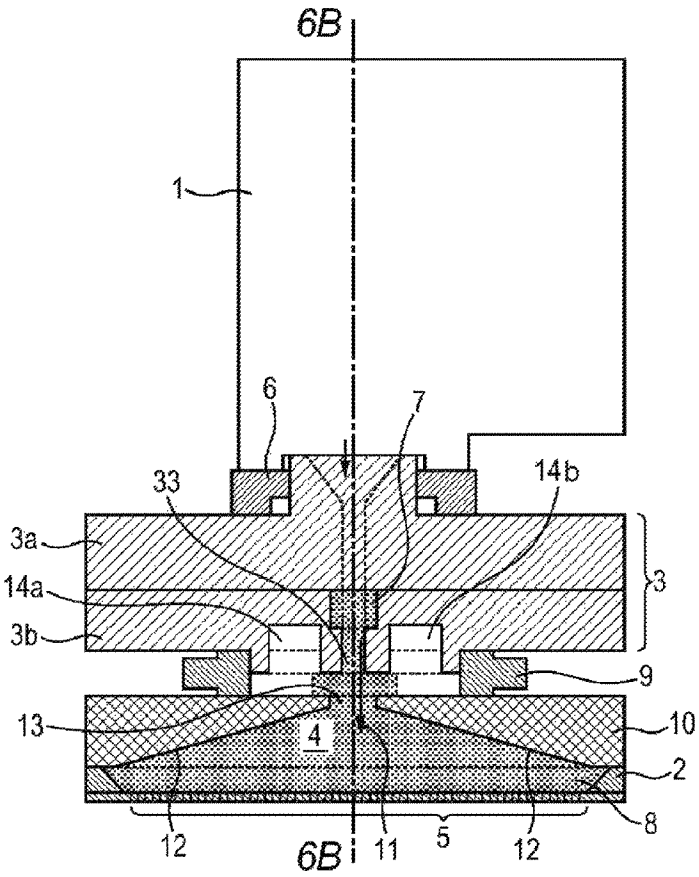

FIG. 5 is a view for illustrating a configuration and an assembly of components of a liquid ejection head according to a second embodiment of the present invention. In the first embodiment, the two liquid chambers 4*a* and 4*b* for the black ink are formed in the support member 10. However, in the second embodiment, only a single liquid chamber for the black ink is formed in the support member 10. Accordingly, the liquid path 7 in the flow path unit 3 for the black ink does not branch off, and only one outlet is formed for the liquid path 7. In accordance with this configuration, as illustrated in FIG. 5, in this embodiment, shapes of the casing 3*a*, the flow path plate 3*b*, and the joint member 9 are partially different from those of the first embodiment. FIG. 6A and FIG. 6B are views for illustrating the liquid ejection head according to the second embodiment further in detail. FIG. 6A is a sectional view for illustrating a flow of the black ink from the liquid tank 1 to the ejection orifice array 5, and FIG. 6B is a sectional view taken along the line 6B-6B of FIG. 6A. In this case, for ease of description, of portions of the casing 3*a*, a portion positioned on a side surface of the liquid tank 1 is not illustrated.

As described above, in the second embodiment, for the black ink, the liquid path 7 does not branch off, and only one liquid chamber 4 is formed in the support member 10. In accordance with this configuration, one inlet 13 is formed for the liquid chamber 4, and the recording liquid is filled from the liquid tank 1 into the liquid chamber 4 through a path 11 indicated by the arrow of FIG. 6A. A slope 12 is formed on a side surface of the liquid chamber 4. Similarly to the first embodiment, the two buffer chambers 14*a* and 14*b* are formed for one inlet 13. This configuration is suitable for a case where a length of the ejection orifice array 5 is smaller than that of the first embodiment, and is particularly suitable for a case where the length of the ejection orifice array 5 is 2 cm or more even when only one liquid chamber is formed. When the length of the ejection orifice array 5 is not so long, a distance from each ejection orifice to the buffer chambers is not so long. Thus, even the buffer chambers 14*a* and 14*b* formed at the vicinity of one inlet 13 can suppress meniscus vibration. The configuration of the second embodiment is effective when it is difficult to form a plurality of liquid chambers in the support member 10.

Also in this embodiment, the buffer chambers 14*a* and 14*b* are located in proximity to the positions connecting to the liquid chamber, and have characteristics equivalent to those of the buffer chamber in the liquid chamber in view of buffering vibration, thereby being capable of effectively suppressing meniscus vibration. A volume of each of the buffer chambers 14*a* and 14*b* is equivalent to 10 $mm^3$ so that, similarly to the first embodiment, as a whole, the liquid chamber 4 can ensure a buffer volume equivalent to 20 $mm^3$. Accordingly, similarly to the above description, as shown in FIG. 4D, also in this embodiment, it is possible to effectively suppress meniscus vibration at the time of ejection at a high flow rate.

Third Embodiment

Figure 7B:
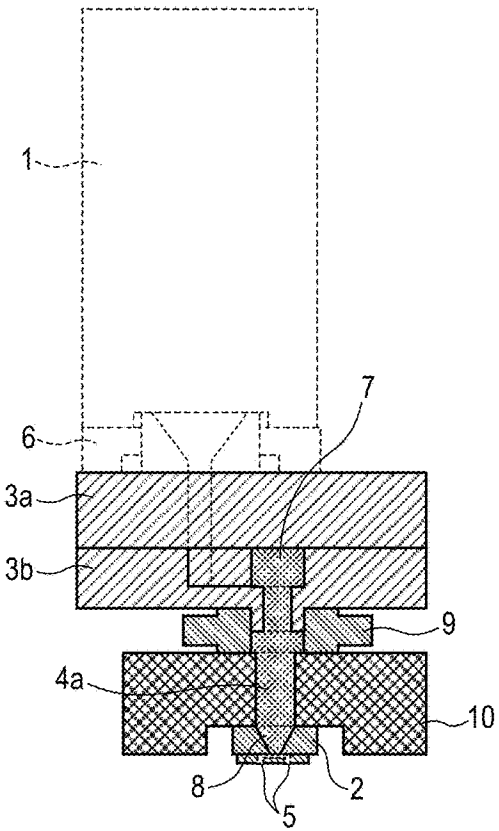
FIGS. 7A and 7B are sectional views for illustrating the internal structure of the liquid ejection head according to the third embodiment.
Figure 7A:
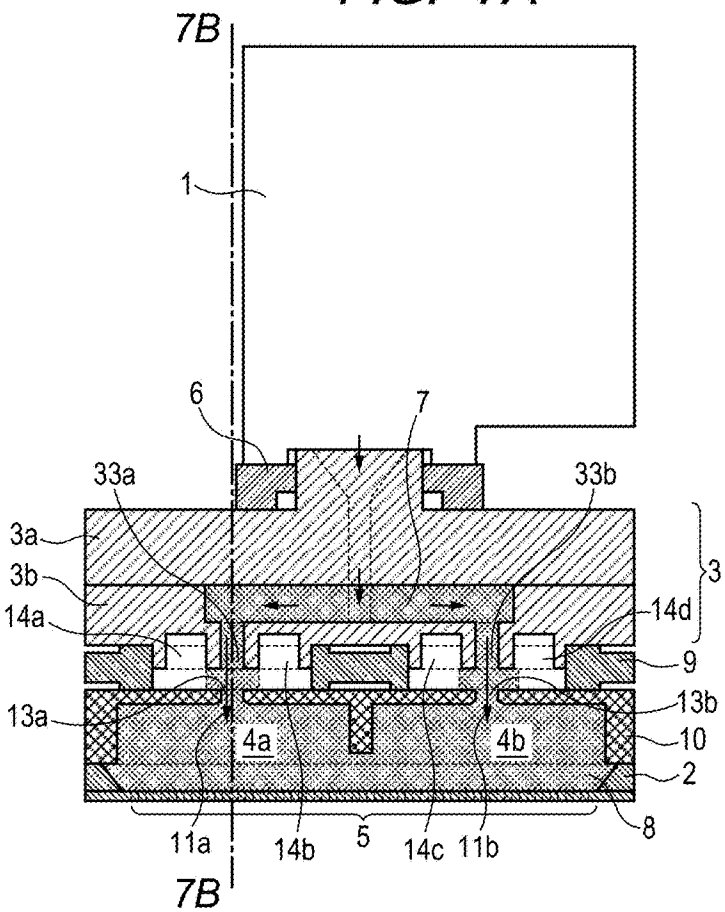

A liquid ejection head according to a third embodiment is similar to the liquid ejection head according to the first embodiment, but shapes of the liquid chambers 4*a* and 4*b* formed in the support member 10 are different from those of the first embodiment. Therefore, the liquid ejection head according to the third embodiment has the same configuration and the same assembly of components as those illustrated in FIG. 1, and hence repeated description thereof is omitted. FIG. 7A is a sectional view for illustrating a flow of the black ink from the liquid tank 1 to the ejection orifice array 5 in the liquid ejection head according to the third embodiment, and FIG. 7B is a sectional view taken along the line 7B-7B of FIG. 7A. In this case, for ease of description, of portions of the casing 3*a*, a portion positioned on a side surface of the liquid tank 1 is not illustrated.

In this embodiment, unlike the first embodiment, a slope is not formed on a side surface of each of the liquid chambers 4*a* and 4*b*, but the liquid chambers 4*a* and 4*b* are each shaped into substantially a rectangular parallelepiped. The above-mentioned liquid chambers each having a rectangular parallelepiped are suitable for a case where air bubbles can be prevented from accumulating in the liquid chambers by contriving a method of filling the recording liquid. Further, this configuration allows reduction of a thickness of the support member 10 necessary for obtaining the same liquid chamber volume, that is, allows thinning of the support member 10. Thus, this configuration is effective in increasing accuracy and reducing cost. Also in this embodiment, the buffer chambers 14*a* to 14*d* are located in proximity to the positions connecting to the liquid chambers, and have characteristics equivalent to those of the buffer chamber in the liquid chamber in view of buffering vibration, thereby being capable of effectively suppressing meniscus vibration. Further, similarly to the first embodiment, a volume of each of the buffer chambers 14*a* to 14*d* is equivalent to 5 $mm^3$ so that, as a whole, the liquid chambers 4*a* and 4*b* can ensure a volume of the buffer chamber equivalent to 20 $mm^3$. As shown in FIG. 4D, also in this embodiment, it is possible to effectively suppress meniscus vibration at the time of ejection at a high flow rate.

Fourth Embodiment

Figure 8B:
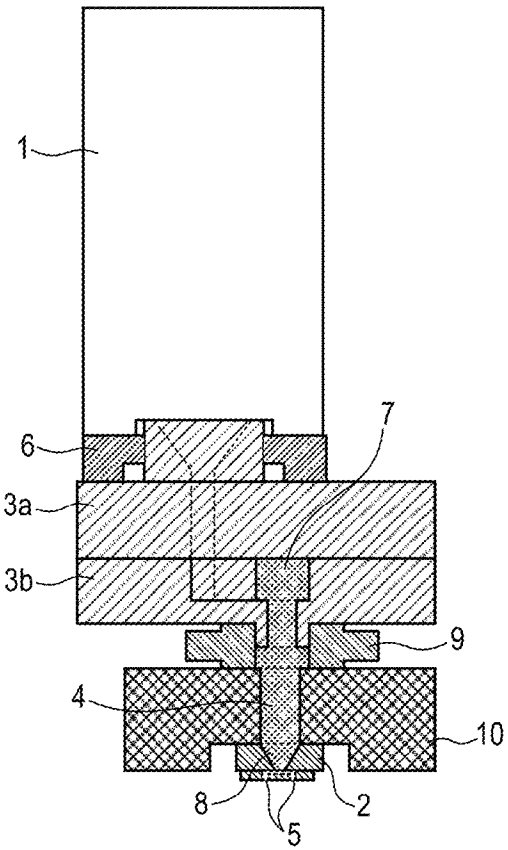
FIGS. 8A and 8B are sectional views for illustrating the internal structure of the liquid ejection head according to the fourth embodiment.
Figure 8A:
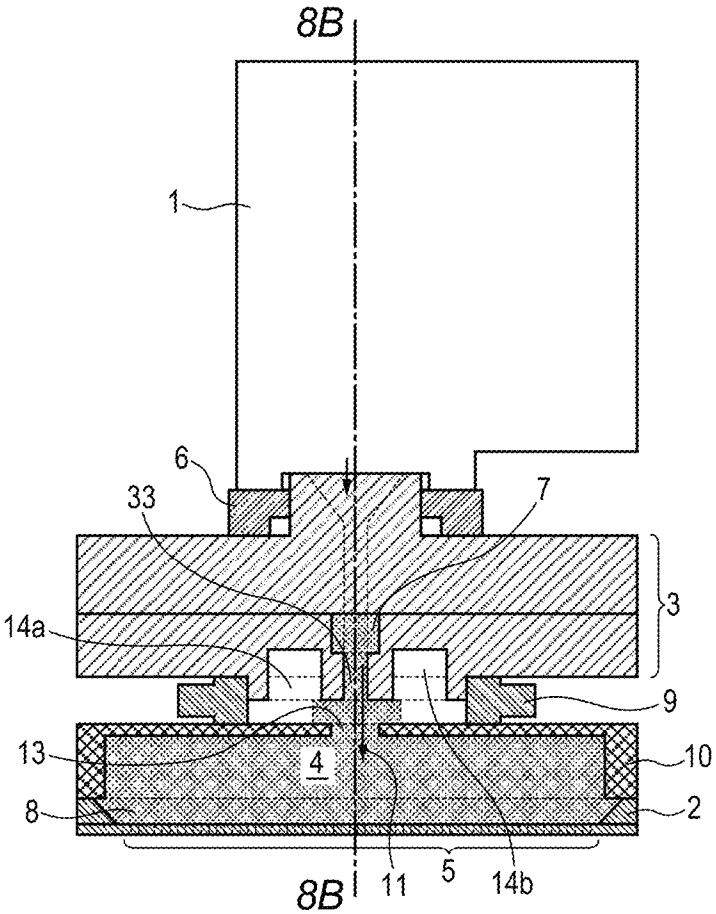

A liquid ejection head according to a fourth embodiment is similar to the liquid ejection head according to the second embodiment, but a shape of the liquid chamber 4 formed in the support member 10 is different from that of the second embodiment. Therefore, the liquid ejection head according to the fourth embodiment has the same configuration and the same assembly of components as those illustrated in FIG. 1, and hence repeated description thereof is omitted. FIG. 8A is a sectional view for illustrating a flow of the black ink from the liquid tank 1 to the ejection orifice array 5 in the liquid ejection head according to the fourth embodiment, and FIG. 8B is a sectional view taken along the line 8B-8B of FIG. 8A. In this case, for ease of description, of the portions of the casing 3*a*, the portion positioned on the side surface of the liquid tank 1 is not illustrated.

The liquid ejection head according to the fourth embodiment is different from the liquid ejection head according to the second embodiment in that the slope 12 is not formed on a side surface of the liquid chamber 4, but the liquid chamber 4 is shaped into substantially a rectangular parallelepiped. That is, this embodiment has both features of the second embodiment and features of the third embodiment, and is suitable for a case where the length of the ejection orifice array 5 is smaller than that of the first embodiment and air bubbles can be prevented from accumulating in the liquid chamber by contriving a method of filling the recording liquid. Also in this embodiment, the buffer chambers 14*a* and 14*b* are located in proximity to the positions connecting to the liquid chamber, and have characteristics equivalent to those of the buffer chamber in the liquid chamber in view of buffering vibration, thereby being capable of effectively suppressing meniscus vibration. Further, a volume of each of the buffer chambers 14*a* and 14*b* is equivalent to 10 $mm^3$ so that, similarly to the first embodiment, as a whole, the liquid chamber 4 can ensure a volume of the buffer chamber equivalent to 20 $mm^3$. As shown in FIG. 4D, also in this embodiment, it is possible to effectively suppress meniscus vibration at the time of ejection at a high flow rate.

The above-mentioned liquid ejection head according to each embodiment ensures a buffer space, which accumulates air bubbles therein, in a space surrounded by the flow path unit 3, the ejection unit 20, and the joint member 9. Accordingly, shapes of components and members are simplified, and the configuration excellent in formability and cleanability is obtained. For example, when the recessed portion is formed in the flow path plate 3*b* of the flow path unit 3 in order to ensure a volumetric space needed for the buffer chamber, it is only necessary to form a recess in the flow path plate 3*b* as long as a minimum thickness is secured between the liquid path 7 and the recess. Therefore, without significantly modifying a related-art process of forming the flow path unit, the flow path unit 3 according to each embodiment can be formed. Further, it is not necessary to directly form the dead-end buffer chamber in the support member 10 or the liquid chamber 4, with the result that the liquid ejection head is excellent in cleanability. Regarding the joint member 9, it is only necessary to enlarge the opening through which the recording liquid is caused to pass. Thus, the joint member 9 has a degree of design freedom, and can be easily manufactured.

Using the liquid ejection head according to each embodiment, pressure vibration at the ejection orifices, which may cause degradation in recording quality, can be attenuated even when the number of ejection orifices is increased to satisfy a need for high-speed recording and it is necessary to supply the liquid at a high flow rate. Therefore, the liquid ejection head can perform recording at high speed with high quality. Further, supply of the liquid such as the recording liquid can be substantially equalized between the respective ejection orifices in the ejection orifice array, and speed of refilling the liquid into the respective ejection orifices can be substantially equalized. Thus, a sufficient refilling amount of the liquid can be ensured. Therefore, the liquid ejection head according to each embodiment also has an effect of preventing deterioration in recording caused by fluctuation factors between the ejection orifices in the ejection orifice array.

Figure 9:
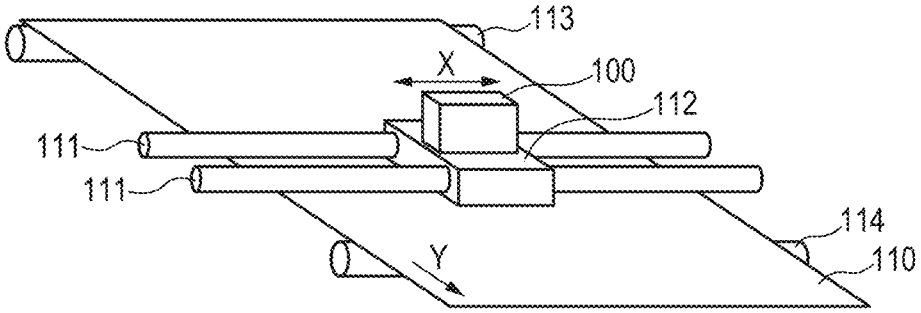
FIG. 9 is a schematic perspective view for illustrating a liquid ejection apparatus using the liquid ejection head according to each embodiment.

FIG. 9 is a view for illustrating a schematic configuration of a liquid ejection apparatus including the above-mentioned liquid ejection head according to each embodiment. The liquid ejection apparatus performs recording on a recording medium 110 such as paper or cloth. A pair of guide shafts 111 is arranged above a conveyance path of the recording medium 110, and a carriage 112 is mounted to the guide shafts 111 so as to be reciprocable in an X direction of FIG. 9. The carriage 112 holds the liquid ejection head 100 including the liquid tank, and the liquid ejection head 100 is inserted in an opening portion formed in a center portion of the carriage 112 so as to pass through the carriage 112. At this time, an ejection orifice surface of the liquid ejection head 100 is exposed from a bottom surface of the carriage 112 (surface opposed to the recording medium 110), and is positioned slightly above an upper surface of the recording medium 110. A direction orthogonal to the above-mentioned X direction is referred to as a Y direction. The recording medium 110 is conveyed in the Y direction of FIG. 9 while being retained on conveyance rollers 113 and 114. When the liquid ejection apparatus performs recording on the recording medium 110, while conveying the recording medium 110 in the Y direction of FIG. 9, the liquid ejection apparatus causes the carriage to reciprocate along the guide shafts 111 in the X direction of FIG. 9, and drives the recording elements in response to a recording signal. In this manner, recording using the liquid such as the recording liquid can be continuously performed on the recording medium 110.

Comparative Examples

Figure 10:
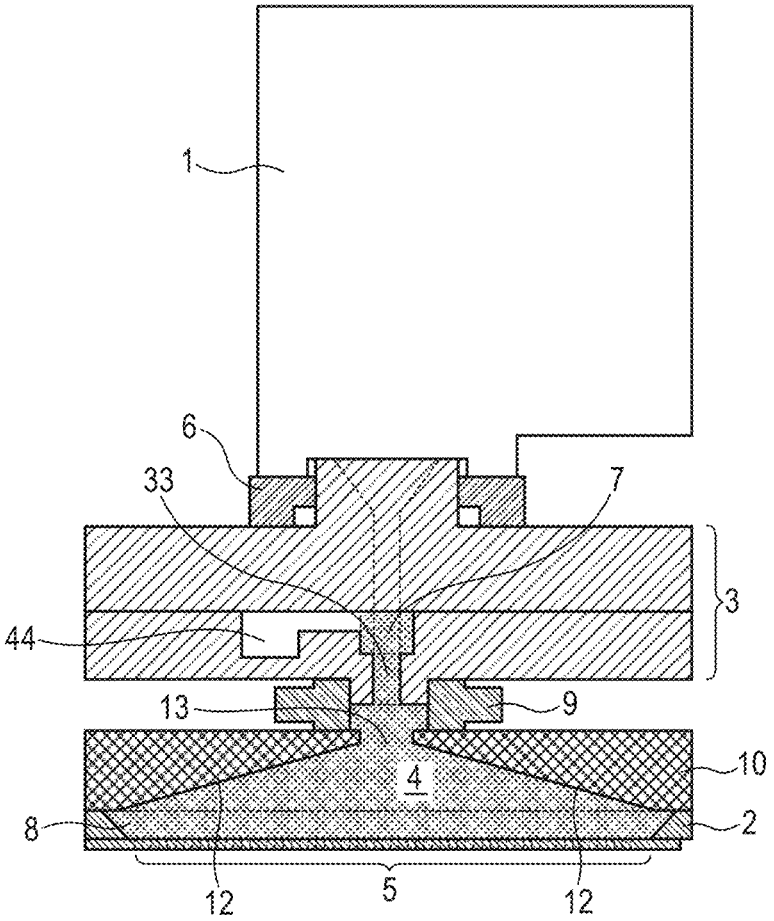
FIG. 10 is a sectional view for illustrating the internal structure of a liquid ejection head according to Comparative Example 1.

Now, a liquid ejection head according to comparative examples is described for contrast with the liquid ejection head according to the present invention. FIG. 10 is a view for illustrating a configuration according to Comparative Example 1, in which a buffer chamber is formed in a halfway point of the liquid path. The liquid ejection head illustrated in FIG. 10 has the configuration similar to that of the liquid ejection head according to the second embodiment, but is different from the liquid ejection head according to the second embodiment in a position of the buffer chamber. In the liquid ejection head illustrated in FIG. 10, a buffer chamber 44 is formed in the flow path unit 3 so as to branch off from the liquid path 7 in the flow path unit 3. In this configuration, a volume of the buffer chamber 44 can be increased, thereby being capable of attenuating pressure vibration having large amplitude. However, the buffer chamber 44 is distant from the ejection orifices. Accordingly, the buffer chamber 44 has such a demerit that it is difficult for the buffer chamber 44 to attenuate pressure vibration in an early period.

Figure 11:
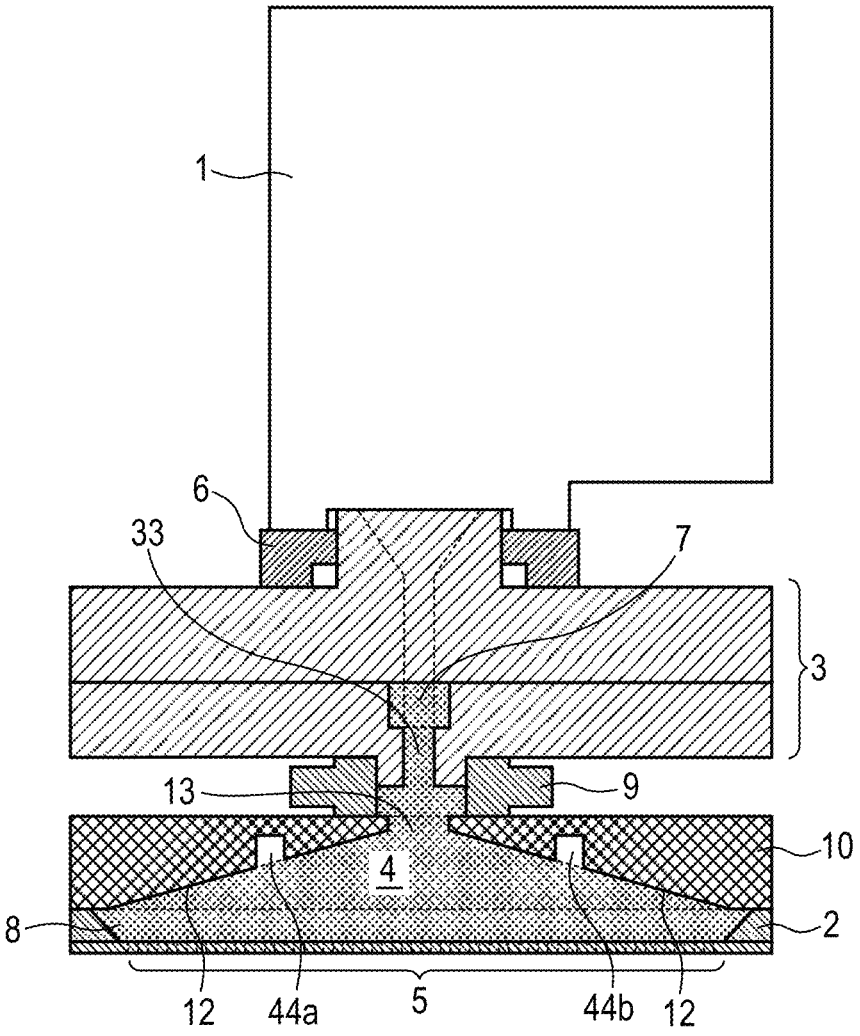
FIG. 11 is a sectional view for illustrating the internal structure of a liquid ejection head according to Comparative Example 2.

FIG. 11 is a view for illustrating a configuration according to Comparative Example 2, in which buffer chambers are formed in the liquid chamber. A liquid ejection head illustrated in FIG. 11 has the configuration similar to that of the liquid ejection head according to the second embodiment, but is different from the liquid ejection head according to the second embodiment in positions of the buffer chambers. In the liquid ejection head illustrated in FIG. 11, buffer chambers 44*a* and 44*b* are formed as small spaces formed in the slope 12 so as to be directly open to the liquid chamber 4. The buffer chambers 44*a* and 44*b* are arranged at positions close to the ejection orifices. Accordingly, the buffer chambers 44*a* and 44*b* can attenuate pressure vibration fluctuating in an earlier period, but cannot have a large volume. Thus, it is difficult for the buffer chambers 44*a* and 44*b* to attenuate pressure vibration having large amplitude. In addition, in the configuration illustrated in FIG. 11, the slope is formed on a side wall of the liquid chamber 4 so as to prevent air bubbles from accumulating in the liquid chamber 4. Due to this configuration, it is further difficult to form a buffer chamber having a large volume. A space for the buffer chamber can be ensured by increasing the thickness of the support member 10. However, the support member 10 has a function of positioning the recording element substrate 2 with high accuracy, and is required to have high heat radiating performance and high gas blocking performance. When the support member 10 has a large thickness, accuracy and heat radiating performance of the support member 10 are deteriorated, and cost is increased. Accordingly, it is difficult for the support member 10 to have a thickness large enough to ensure a necessary and sufficient volume of the buffer chamber. Further, when the large buffer chambers 44 are ensured, there is a fear in that air bubbles in each buffer chamber 44 may be discharged because the slope 12 is formed on the side wall of the liquid chamber 4 so as to prevent accumulation of air bubbles. The buffer chamber 44 buffers pressure using air bubbles accumulated in the buffer chamber 44. Accordingly, when air bubbles are discharged from the buffer chamber 44, the buffer chamber does not function. The buffer chamber 44 in the liquid chamber 4 is a dead-end portion connecting to the liquid chamber 4. Thus, the buffer chamber 44 has a problem in that an inside of the buffer chamber 44 is not cleaned sufficiently, and that a long time period is required to dry the buffer chamber 44 after cleaning.

According to the present invention, even when the number of ejection orifices is large and it is necessary to supply ink at a high flow rate, it is possible to attenuate meniscus vibration at the ejection orifices in the liquid ejection head. Thus, it is possible to perform recording at high speed with high quality.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-146457, filed Jul. 24, 2015, which is hereby incorporated by reference herein in its entirety.

What is claimed is:

1. A liquid ejection head, comprising:

an ejection unit comprising:

a recording element substrate having ejection orifices for allowing liquid to be ejected from the ejection orifices, the recording element substrate comprising a plurality of recording elements configured to generate energy for ejecting the liquid from the ejection orifices; and a support member formed of a plate-like member and configured to support the recording element substrate, the support member comprising:

a liquid chamber configured to store therein the liquid to be supplied to the recording element substrate; and an inlet formed in the liquid chamber so as to allow the liquid to flow into the liquid chamber;

a flow path unit comprising a liquid path through which the liquid is supplied into the ejection unit from a liquid tank storing the liquid therein;

a joint member sandwiched between the support member and the flow path unit and configured to seal the liquid while keeping the liquid flowing between an outlet of the liquid path of the flow path unit and the inlet of the support member; and a buffer chamber formed in a space defined by the joint member, the ejection unit, and the flow path unit and configured to retain gas therein.

2. A liquid ejection head according to claim 1, wherein the joint member comprises a rubber member having an opening formed therein so as to include a path of the liquid from the outlet to the inlet and a formation position of the buffer chamber, and wherein the flow path unit is held in press-contact with the support member through intermediation of the joint member.

3. A liquid ejection head according to claim 2, wherein the buffer chamber comprises a plurality of buffer chambers each formed for the opening of the joint member.

4. A liquid ejection head according to claim 1, wherein the liquid chamber comprises a plurality of liquid chambers formed in the support member, wherein the inlet is formed in each of the plurality of liquid chambers, wherein the liquid path branches off in accordance with a number of the plurality of liquid chambers, wherein the outlet is formed for each branch of the liquid path, and wherein the buffer chamber is formed for each corresponding pair of the outlet and the inlet.

5. A liquid ejection head according to claim 4, wherein the joint member comprises a rubber member having an opening formed therein for the each corresponding pair of the outlet and the inlet so as to include a path of the liquid from the outlet to the inlet and a formation position of the buffer chamber, and wherein the flow path unit is held in press-contact with the support member through intermediation of the joint member.

6. A liquid ejection head according to claim 1, wherein the flow path unit has a recessed portion formed in a surface thereof around the outlet in conformity to a position of the buffer chamber.

7. A liquid ejection head according to claim 1, wherein the liquid chamber has a slope formed on a side surface thereof so that the liquid chamber extends from the inlet toward the recording element substrate in a plane including the inlet and an ejection orifice array of the recording element substrate.

8. A liquid ejection head according to claim 1, wherein the recording element substrate has a plurality of the ejection orifices, and wherein the plurality of the ejection orifices construct an ejection orifice array having a length of 2 cm or more.

* * * * *